United States Patent [19]

Brown et al.

[11] 3,998,075

[45] Dec. 21, 1976

[54] CIRCULAR KNITTING MACHINE QUICK DRIVE DISCONNECT

[75] Inventors: Robert Saul Brown, Spartanburg; Paul W. Eschenbach, Inman; Herbert Ray King, Spartanburg, all of S.C.

[73] Assignee: Deering Milliken Research Corporation, Spartanburg, S.C.

[22] Filed: Apr. 28, 1975

[21] Appl. No.: 572,432

[52] U.S. Cl. ..... 66/149 R; 192/67 R; 242/67.1 R

[51] Int. Cl.[2] ..... D04B 15/88

[58] Field of Search ..... 192/67 R, 108; 66/151, 66/149 R; 242/67.1 R, 67.4; 26/70

[56] References Cited

UNITED STATES PATENTS

| | | | |
|---|---|---|---|
| 1,047,801 | 12/1912 | Haney | 192/67 R |
| 2,158,177 | 5/1939 | Firsching | 66/151 |
| 2,595,055 | 4/1952 | Clark et al. | 242/67.4 |
| 2,619,211 | 11/1952 | Belden | 192/67 R |
| 2,751,768 | 6/1956 | Lebocey | 66/151 |
| 3,251,112 | 5/1966 | Ingham | 26/70 |
| 3,695,062 | 10/1972 | Schaack | 66/151 |
| 3,839,885 | 10/1974 | Bourgeois | 66/151 |
| 3,850,012 | 11/1974 | Bourgeois | 66/151 |

*Primary Examiner*—Mervin Stein
*Assistant Examiner*—Andrew M. Falik
*Attorney, Agent, or Firm*—H. William Petry; Earle R. Marden

[57] ABSTRACT

An improved circular knitting machine which provides for semiautomatic doffing of large diameter rolls of knit fabric. The doffing of the fabric can be accomplished by a woman operator without strain. The improved circular knitting machine provides a quick diconnect from the drive to take the tension of the machine to allow machine repair without extensive dismounting of the machine.

6 Claims, 16 Drawing Figures

CIRCULAR KNITTING MACHINE QUICK DRIVE DISCONNECT

It is an object of the invention to provide a more efficient circular knitting machine which will allow the production of large rolls of fabric which can be more readily doffed from the knitting machine.

Other objects and advantages of the invention will become clearly apparent as the specification proceeds to describe the invention with reference to the accompanying drawings, in which.

Figure 1:
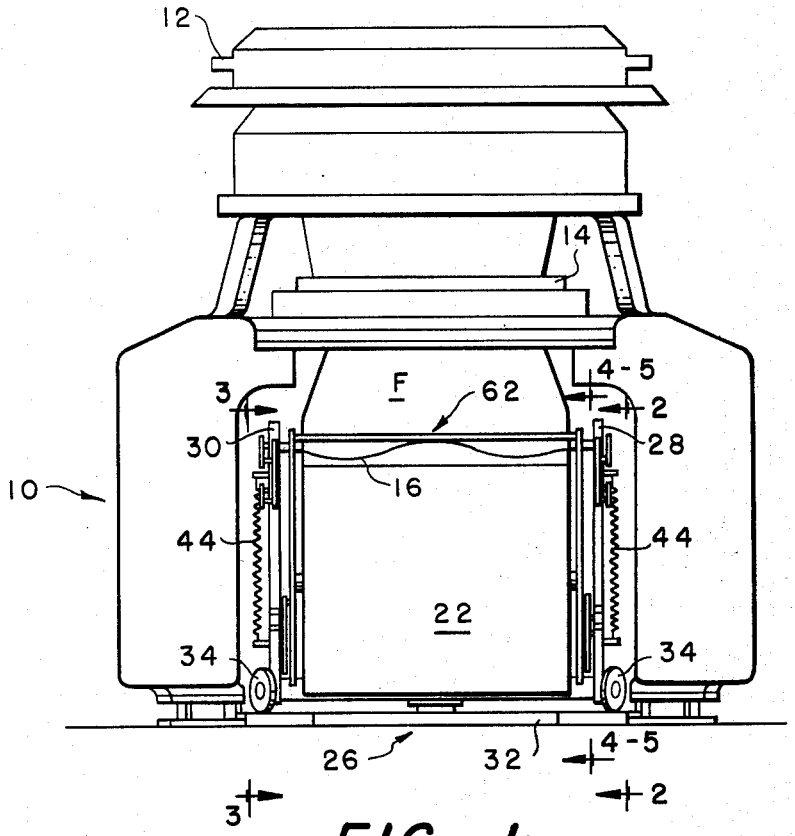
FIG. 1 is a front elevation partially schematic view of a circular knitting machine incorporating the novel doffing apparatus.
Figure 6:
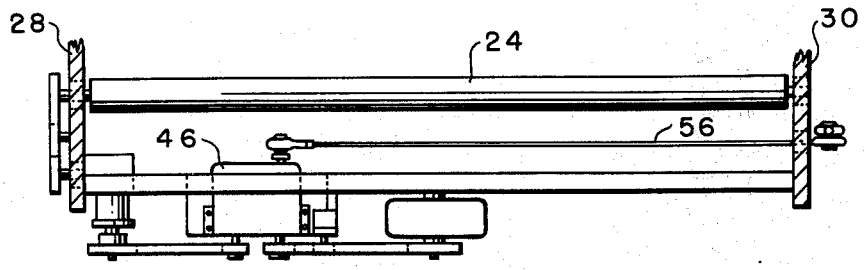
FIG. 6 is a top section view taken on line 6—6 of FIG. 3.
Figure 2:
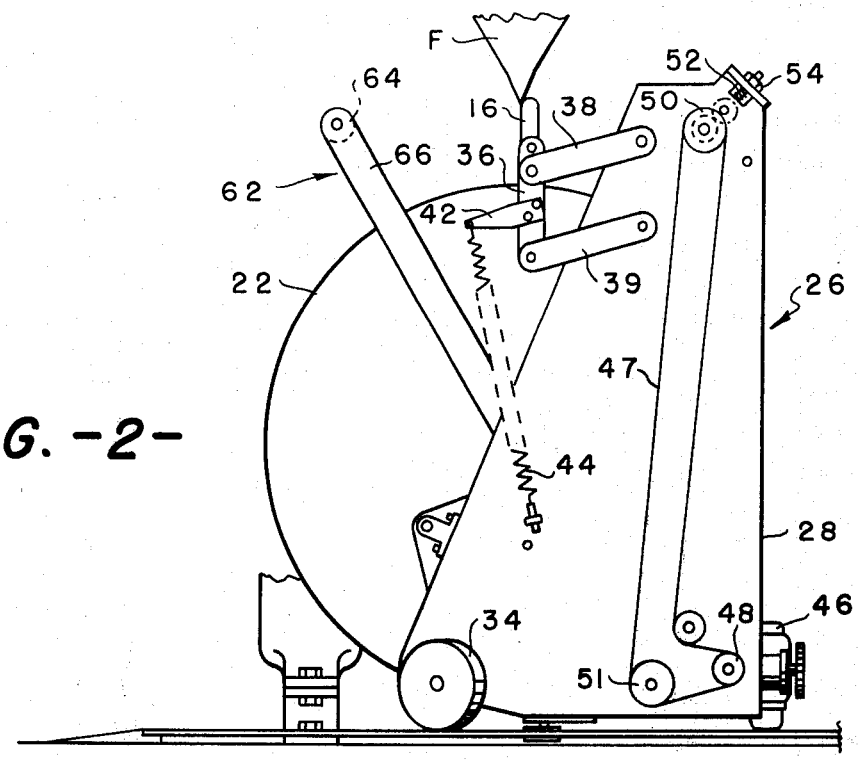
FIG. 2 is a view taken on line 2—2 of FIG. 1 showing one side of the take-down and take-up arrangement.
Figure 3:
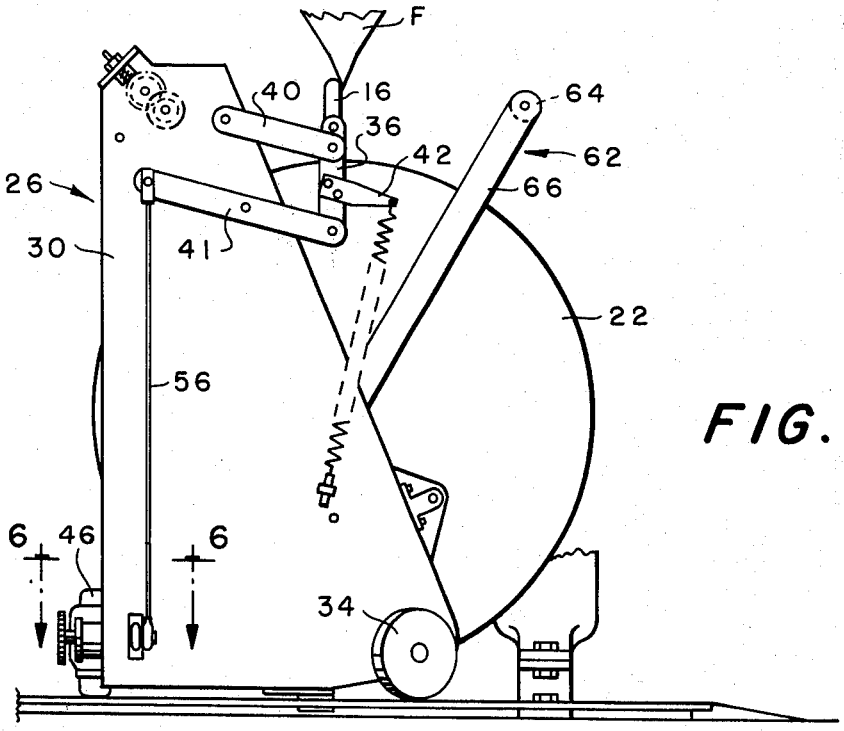
FIG. 3 is a view taken on line 3—3 of FIG. 1 showing the other side of the take-down and take-up apparatus.

Looking now to FIG. 1 there is shown a conventional double knit circular knitting machine 10 supplied with a plurality of yarns from an off-side creel (not shown). The yarn is supplied through the yarn guide ring 12 to the rotating needle cylinder 14 whereat it is knit into a tube of fabric F. The fabric F from the needle cylinder 14 passes downwardly over a conventional spreader bar 15 to spread it into a flat shape and then passes under the oxbow shaped rod 16 and over the secondary spreader bar 17 to the driven take-down rolls 18 and 20 which are off-set rearwardly from the centerline of the knitting machine. From the take-down rolls 18 and 20 the flattened fabric F is delivered to the take-up roll 22 which is driven by surface drive roll 24 which is also off-set rearwardly from the centerline of the knitting machine.

The fabric take-down structure, generally designated 26 and shown in detail in FIGS. 2–6, is supported by the upright frame members 28 and 30 and rotates on track 32 in synchronism with the rotation of the needle cylinder 14 via wheels 34 rotatably connected to the frame members 28 and 30.

The oxbow shaped rod 16 is suspended for vertical movement by arms 36 which are pivotally secured to lever arms 38, 39, 40 and 41 pivotally mounted to the frame members 28 and 30 substantially parallel to one another. To bias the rod 16 in the downward position another lever arm 42 is fixed to each of the arms 36 and has a spring member 44 connected thereto with the other end of the spring being connected to each of the frame members 28 and 30.

As described briefly above, the rod 16 is oxbow shaped and is located between the needle cylinder 14 and the take-down rolls 18 and 20 so that the fabric F passes under the rod 16 as it passes to the take-down rolls 18 and 20. For the most efficient operation of the machine it is desired to maintain the tension berween needle cylinder 14 and the take-down rolls 18 and 20 substantially the same across the width of the fabric F. Since the fabric length adjacent the center of the fabric F is longer than the fabric length adjacent the ends of the fabric when the cylinder of knit fabric at the cylinder needles 14 is spread and flattened under the same theoretical tension, it is necessary to decrease the length of travel of the center of the flattened fabric F between the needle cylinder 14 and the take-down rolls 18 and 20 relative to the path of travel of the flattened fabric outward of the center of the fabric to maintain a constant tension across the width of the fabric since the take-down rolls apply a substantially even pull across the width of the flattened fabric F. Therefore, the rod 16 is oxbow shaped to decrease the path of travel of the fabric at the center of the rod and increase the path of travel of the fabric slightly outward of the center of the fabric to compensate for the differential fabric lengths developed when the cylinder or tube of fabric is spread and flattened prior to delivery to the take-down rolls 18 and 20. As noted briefly before, a secondary spreader bar 17 is located inside the flattened fabric tube F to control the width of the tube. The secondary spreader bar 17 has a pair of wheels 82 and 84 pivotally mounted on each end thereof to roll inside the fabric as the fabric is drawn by the take-down rolls 18 and 20. Bar 17 basically consists of two threaded portions 86 and 88 with a turnbuckle 90 mounted therebetween to vary the width of the fabric F. The spreader bar 17 is secured to the spreader bar 15 by means of cables 92 which pass under the oxbow shaped rod 16 inside the fabric.

As discussed briefly, the needle cylinder 14 and the take-down apparatus 26 are rotated in synchronism by a drive means (not shown). The take-down rolls 18 and 20 and the surface drive roll 24 are driven by a separate variable speed drive motor 46 mounted on the knitting machine. The drive motor 46 drives both the roll 20 and 24 through a suitable drive belt 47 connected to the sprocket 48 operably associated with the shaft of the drive motor, the sprocket 50 on the shaft of take-down roll 20 and the sprocket 51 on the shaft of the surface drive roll 24. To maintain nip pressure between rolls 18 and 20, the roll 18 is spring located by means of a spring 52 toward the roll 20 and can be adjusted by adjustment of the nut 54. When the nip pressure between the take-down rolls 18 and 20 has been adjusted the speeds of the take-down rolls 18 and 20 and the surface roll are automatically and simultaneously adjusted in accordance with the pull down tension in the fabric F by the vertical position of the rod 16. The vertical position of the rod 16 through the arm 36 and the lever 41 controls the vertical position the rod 56 connected to the lever 41 which in turn adjusts the speed of the variable speed motor 46.

As noted above, the take-down rolls 18 and 20 are off-set from the centerline of the machine toward the rear thereof to allow the production of a larger roll 22. When producing such a roll it is necessary to provide a means to readily doff same, especially when using female knitting machine operators. To this end the doffing mechanism consisting of a pair of lever arms 58, a pair of bell cranks 60, and a doffing handle mechanism 62 is employed. The doffing mechanism basically consists of a doffing handle 64 connected to a pair of elongated lever arms 66 each of which has a groove 68 therein facing toward the take-up roll 22. Each of the lever arms 58 is pivotally connected to one of the lever arms 66 at 70 and to the inner wall of the respective frame member 28 or 30 at 71. Each of the bell cranks 60 is also pivotally connected to one of the elongated lever arms 66 at 72 and to the inner wall of the respective frame member 28 or 30 at 74. Rigidly secured to each of the elongated lever arms 66 is a bracket member 67 which has a roll support rod 69 therebetween.

Figure 4:
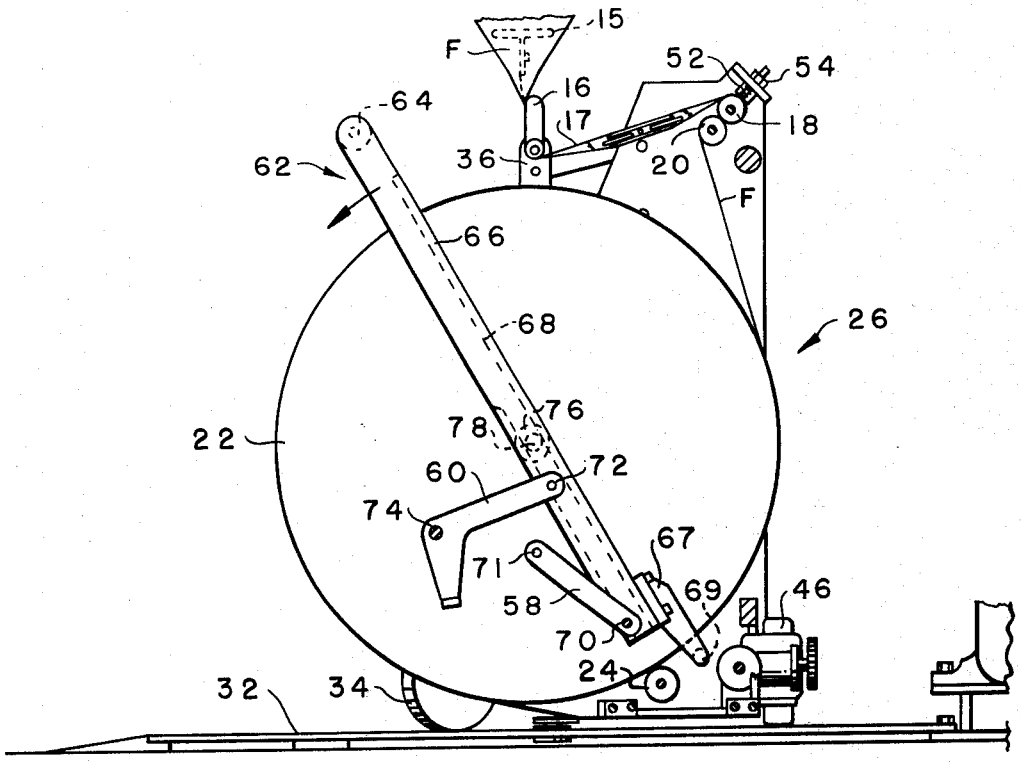
FIGS. 4 and 5 are views taken on line 45—45 of FIG. 1 showing the take-up roll partially doffed (FIG. 4) and in the full doffing position (FIG. 5)
Figure 5:
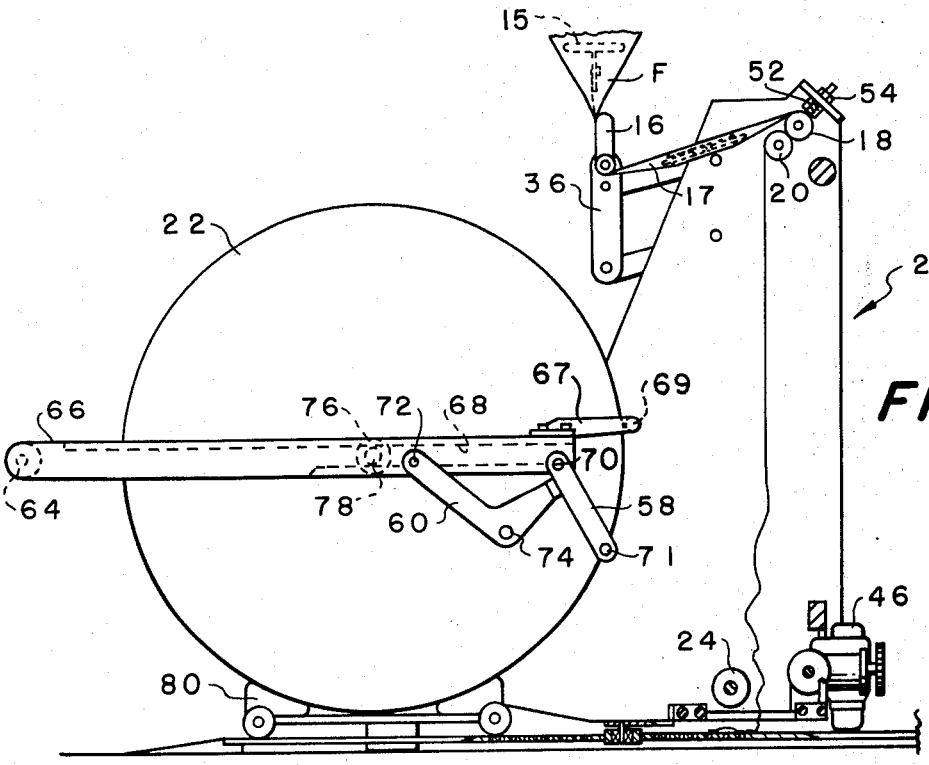
Figure 7:
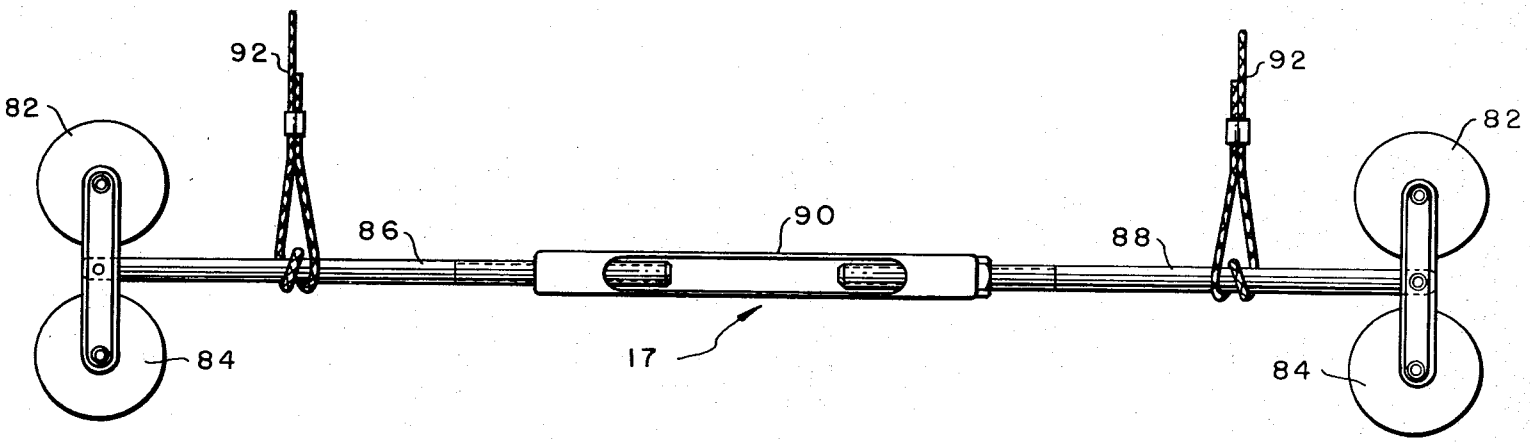
FIG. 7 is a top view of the secondary spreader bar.
Figure 8:
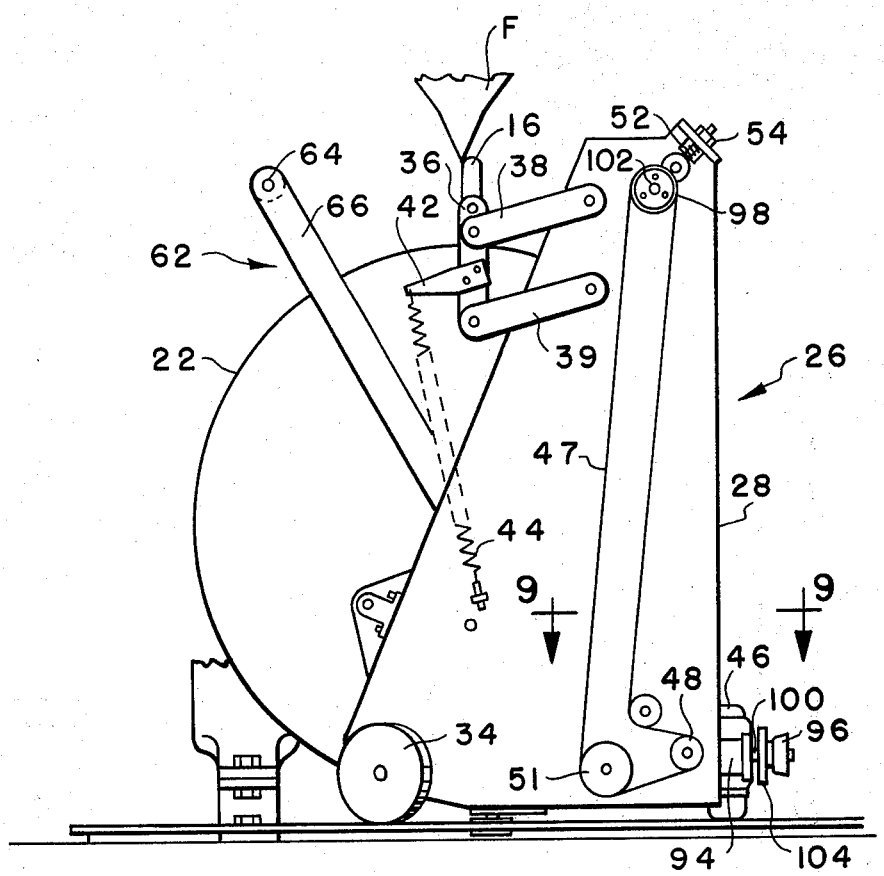
FIG. 8 is a view similar to FIG. 2 showing quick disconnects attached to the take-down rolls and the gear drive for various components of the system.
Figure 9:
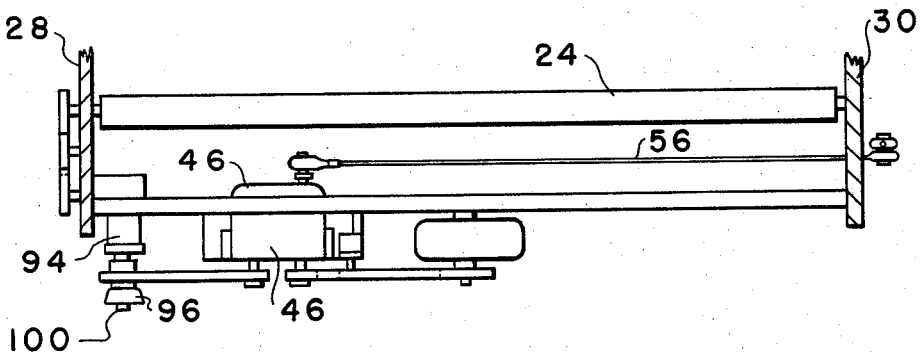
FIG. 9 is a top section view taken on line 9—9 of FIG. 8.
Figure 11:
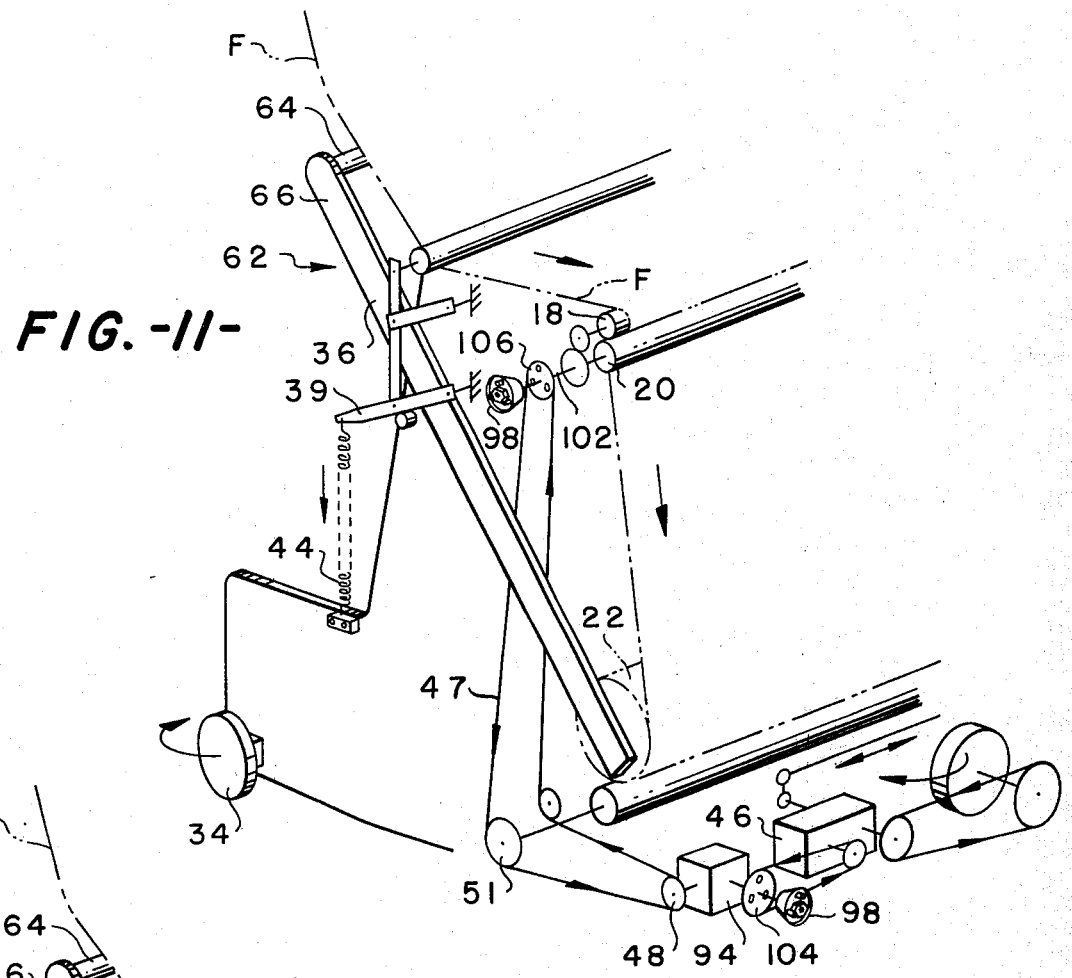
FIGS. 10 and 11 are schematic views showing the quick disconnects in operative and inoperative position.
Figure 10:
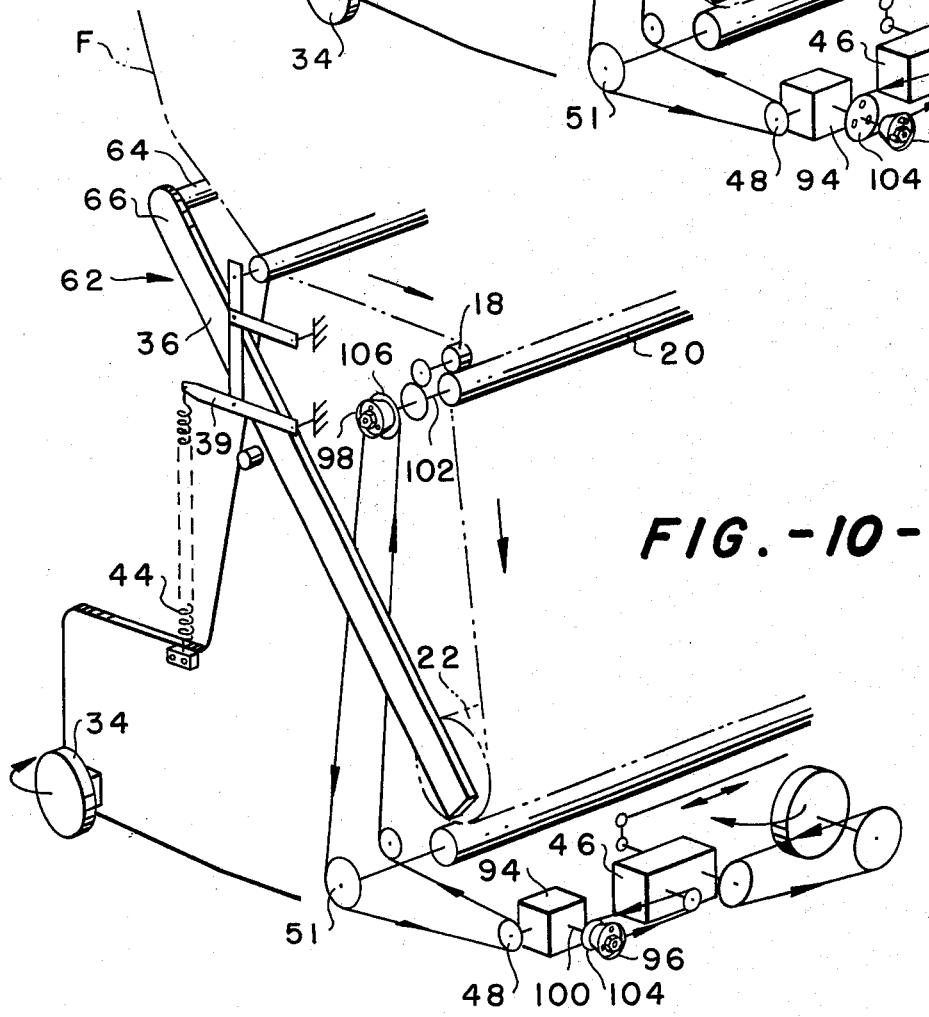
Figure 12:
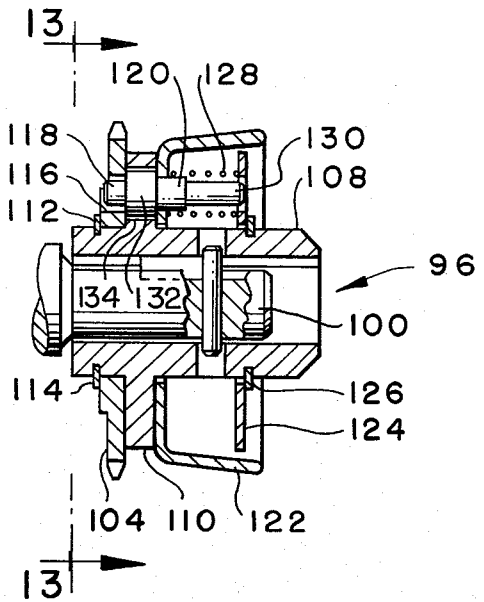
FIGS. 12 and 14 show the quick disconnects per se in operative and inoperative positions, respectively.

Looking now primarily to FIGS. 4 and 5 the doffing operation will be explained. As is well known the take-up roll winds up the fabric F on a tube 76 in which is inserted a core 78. As shown in FIGS. 4 and 5 the core 78 is slidably mounted in the groove 68 so that as the roll grows in diameter the core and tube will move upwardly. When the desired diameter roll is wound the doff handle 64 is grasped and moved in a counterclockwise direction to unroll the roll 22 somewhat to provide a fabric tail and to rotate the support 69 counterclockwise into engagement with the roll 22 to aid in causing the roll to be lowered onto the buggy 80. The core is guided by the links 58 and 60 to raise the center approximately 4 inches before the roll is lowered toward the buggy 80. As the handle is being rotated to a horizontal position it is pulled to the left (FIGS. 4 and 5) to aid in depositing the roll 22 on the buggy 80. Then the doff handle is pushed to the right until the core 78 drops out of the groove 68 to disengage the roll 22. The core 78 is then disengaged from the tube 76, the fabric cut and the buggy moved to a remote position. Then the doffing mechanism is in position to be loaded with a new tube and be threaded up with more fabric.

FIGS. 10–16 show in detail the use of a quick disconnect to allow a repair or serviceman to service the machine without having to dismantle portions thereof due to the tension on various components. In FIGS. 10–16 components like those in FIGS. 1–9 are denoted by the same reference numeral.

In a mechanism of the tupe disclosed it is necessary at times to make minor repairs on the doffer mechanism, replace bearings, etc. but this becomes difficult when tension is maintained in the system by the gear box 94 and the drive chain 47 which maintain the various elements under tension. Therefore, the quick disconnects 96 and 98 are used to allow the respective shafts 100 and 102 connected to rotate freely and not be inhibited against rotation by their driving elements. To accomplish this end the qick disconnects 96 and 98 provide a means for the shafts 100 and 102 to rotate independent of their respective sprockets 104 and 106.

Looking now to FIGS. 12–16 one of the quick disconnects is shown in detail. The disconnects 96 and 98 are identical and for purposes of explanation the disconnect 96 is shown in FIGS. 13–16. The sprocket 104 driven by drive motor 46 is mounted around hollow connector 108 against the integral collar 110 and held on by the snap ring 112 located in groove 114. The sprocket 104 has a plurality of openings 116 therein to accommodate the smaller diameter portion 118 of the stepped pin 120 which is mounted to the circular flanged collar member 122. A retaining plate 124 surrounding the connector 108 is prevented from sliding off by snap spring 126 and provides an abutment for the springs 128 which surround the outer end 130 of the pins and abut the inside of the flanged collar member 122.

Figure 15:
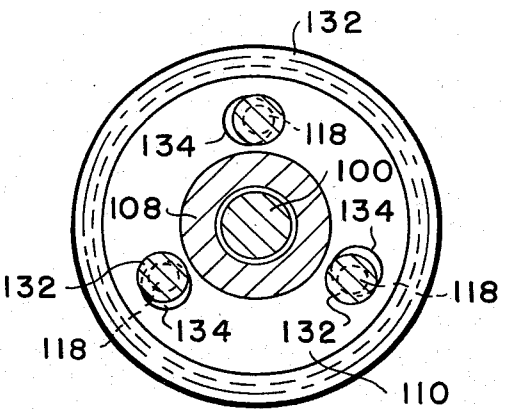
FIG. 15 is a view taken on line 15—15 of FIG. 14.
Figure 13:
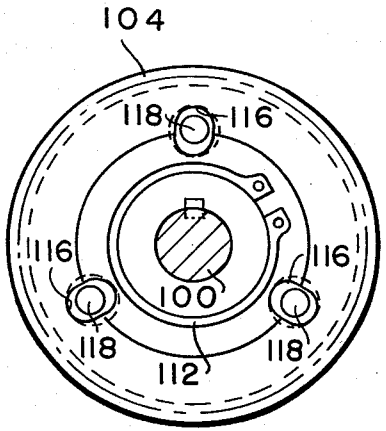
FIG. 13 is a view taken on line 13—13 of FIG. 12.
Figure 14:
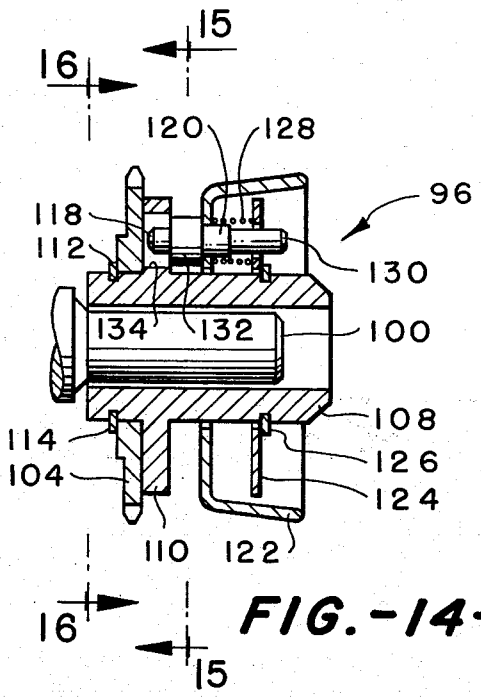
Figure 16:
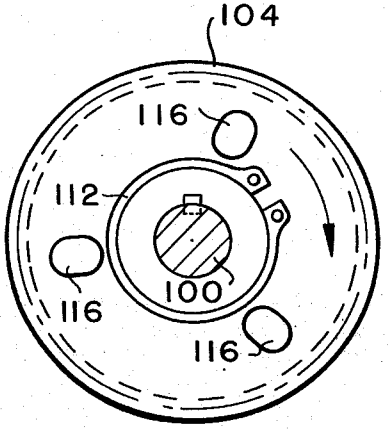
FIG. 16 is a view taken on line 16—16 of FIG. 14.

When it is desired for any purpose to release the tension on the fabric F and allow access to various portions of the machine, the motor 46 is stopped and the flanged collar member 122 is pulled back against the tension of springs 128 to pull the pin portion 118 into the position shown in FIGS. 14–16. The collar flanged member 122 is then rotated slightly and released so that the larger pin portion 132 of the pins 120 will abut the edge of openings 134 in the collar 110 to maintain the pin portion 118 out of contact with the sprocket 104. Then the collar 122 along with collar 110 and connection shaft 108 can be manually rotated to back the fabric off the take-up roll 22 to allow the springs 44 to move the linkage 36, 39 to the position shown in FIG. 11 since the drive sprocket 104 is now free wheeling on the connection shaft 108.

Also, if it is necessary to remove the fabric F from between the rolls 18 and 20 the quick disconnect 98 is operated in the same manner as quick disconnect 96 to allow the sprocket 106 to free wheel on its shaft so the roll 20 can be manually rotated by the flanged collar 122 to unthread and thread-up the rolls 18 and 20 when desired. To reconnect the sprockets 104 and 106 the flanged collars 122 are pulled back and rotated to a position where the pin portion 118 is realigned with the openings 116 in the respective sprockets and then is released to re-engage the sprockets with the respective drive shafts.

It is obvious than an improved circular knitting machine has been provided that can roll up large rolls of knit fabric and which at the same time can be readily doffed with a minimum of effort.

Although the preferred embodiment of the invention has been described, it is contemplated that many changes may be made without departing from the scope or spirit of the invention and it is desired that the scope of the invention be limited only by the claims.

That which is claimed is:

1. A circular knitting machine comprising: first means to produce a knitted fabric, a second means to take up the knitted fabric mounted on said machine, a pair of rolls in nip forming relationship located between said first means to produce and said second means to take up knitted fabric receiving fabric from said first means to produce and delivering knitted fabric to said second means to take up fabric, a third means to drive said pair of rolls and said second means to take up fabric in synchronism, a fourth means driving said third means and a fifth means resiliently held into readily releasable engagement with said fourth means to cause said fourth means to drive said third means.

2. The machine of claim 1 said fourth means includes a shaft and a sprocket mounted on said shaft, said fifth means includng a spring loaded sprocket engaging means to cause said sprocket to drive said shaft.

3. The machine of claim 2 wherein said sprocket has a plurality of openings therein and said spring loaded sprocket engaging means has a plurality of pins attached thereto to engage said openings in said sprockets.

4. The machine of claim 1 said pair of rolls includes a means to disconnect said third means from driving relationship with said pair of rolls.

5. The machine of claim 4 said fourth means includes a shaft and a sprocket mounted on said shaft, said fifth means including a spring loaded sprocket engaging means to cause said sprocket to drive said shaft.

6. The machine of clam 5 wherein said sprocket has a plurality of openings therein and said spring loaded sprocket engaging means has a plurality of pins attached thereto to engage said openings in said sprockets.

* * * * *